US011421550B2

(12) United States Patent
Jang et al.

(10) Patent No.: US 11,421,550 B2
(45) Date of Patent: Aug. 23, 2022

(54) RING SEGMENT, AND TURBINE AND GAS TURBINE INCLUDING THE SAME

(71) Applicant: DOOSAN HEAVY INDUSTRIES & CONSTRUCTION CO., LTD., Changwon-si (KR)

(72) Inventors: Yun Chang Jang, Gimhae-si (KR); Andrey Sedlov, Würenlos (SZ); Thomas Kotteck, Untersiggenthal (SZ)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 16/889,254

(22) Filed: Jun. 1, 2020

(65) Prior Publication Data

US 2020/0408108 A1 Dec. 31, 2020

(30) Foreign Application Priority Data

Jun. 25, 2019 (KR) ..... 10-2019-0075793

(51) Int. Cl.
*F01D 25/14* (2006.01)
*F01D 9/04* (2006.01)

(52) U.S. Cl.
CPC ..... *F01D 25/14* (2013.01); *F01D 9/04* (2013.01); *F05D 2240/14* (2013.01);
(Continued)

(58) Field of Classification Search
CPC . F01D 9/023; F01D 9/04; F01D 9/041; F01D 11/08; F01D 25/12; F01D 25/14;
(Continued)

(56) References Cited

U.S. PATENT DOCUMENTS 5,993,150 A * 11/1999 Liotta ..... F01D 11/10 415/115
7,033,138 B2 * 4/2006 Tomita ..... F01D 11/005 415/139

(Continued)

FOREIGN PATENT DOCUMENTS

EP 1407193 B1 8/2004
JP 1999022411 A 1/1999

(Continued)

OTHER PUBLICATIONS

Korean Office Action issued by the Korean Intellectual Property Office (KIPO) dated Jun. 12, 2020.

*Primary Examiner* — Courtney D Heinle
*Assistant Examiner* — Danielle M. Christensen
(74) *Attorney, Agent, or Firm* — Harvest IP Law LLP

(57) ABSTRACT

A ring segment, a turbine, and a gas turbine having improved cooling performance are provided. The ring segment may include a shielding wall mounted to a turbine casing which accommodates a turbine blade and configured to face an inner circumferential surface of the turbine casing, a first hook part and a second hook part configured to protrude from the shielding wall toward the turbine casing to be coupled to the turbine casing, a main cavity formed between the first hook part and the second hook part, a plurality of first cooling passages configured to connect the main cavity and first side surfaces facing each other of the shielding wall, a plurality of second cooling passages configured to extend in a direction crossing the first cooling passage and connect the main cavity and second side surfaces facing each other of the shielding wall, and a chamber configured to be connected to the first cooling passages.

15 Claims, 6 Drawing Sheets

(52) U.S. Cl.
CPC .. *F05D 2250/185* (2013.01); *F05D 2260/201* (2013.01); *F05D 2260/30* (2013.01)

(58) Field of Classification Search
CPC ..... F01D 25/24; F01D 25/243; F01D 25/246; F05D 2240/11; F05D 2240/12; F05D 2240/14; F05D 2240/81; F05D 2250/185; F05D 2260/20; F05D 2260/201; F05D 2260/204; F05D 2260/30
See application file for complete search history.

(56) References Cited

U.S. PATENT DOCUMENTS

| | | | | |
|---|---|---|---|---|
| 7,670,108 | B2 * | 3/2010 | Liang | F01D 11/005 415/173.1 |
| 7,988,410 | B1 * | 8/2011 | Liang | F01D 9/04 415/173.1 |
| 8,388,300 | B1 * | 3/2013 | Liang | F01D 11/08 415/1 |
| 8,727,704 | B2 | 5/2014 | Lee et al. | |
| 9,464,538 | B2 * | 10/2016 | Sezer | F01D 25/12 |
| 2007/0041827 | A1 | 2/2007 | Camus | |
| 2011/0044805 | A1 * | 2/2011 | Koyabu | F01D 11/08 415/177 |
| 2013/0011238 | A1 * | 1/2013 | Liang | F01D 11/24 415/115 |
| 2014/0286751 | A1 | 9/2014 | Brunelli et al. | |
| 2017/0058684 | A1 | 3/2017 | Correia et al. | |

FOREIGN PATENT DOCUMENTS

| | | | |
|---|---|---|---|
| JP | 6291799 | B2 | 6/2013 |
| KR | 101820852 | B1 | 1/2018 |
| KR | 101873156 | B1 | 6/2018 |
| KR | 1020180091337 | A | 8/2018 |
| KR | 101965505 | B1 | 4/2019 |

* cited by examiner

RING SEGMENT, AND TURBINE AND GAS TURBINE INCLUDING THE SAME

CROSS-REFERENCE TO RELATED APPLICATION

This application claims priority to Korean Patent Application No. 10-2019-0075793, filed on Jun. 25, 2019, the disclosure of which is incorporated by reference herein in its entirety.

BACKGROUND

Field

Apparatuses and methods consistent with exemplary embodiments relate to a ring segment, and a turbine and a gas turbine including the same.

Description of the Related Art

A gas turbine is a power engine which mixes fuel with air compressed in a compressor, combusts the mixture of the fuel and the compressed air, and rotates a turbine with high-temperature gas generated by the combustion. The gas turbine is used to drive a generator, an aircraft, a ship, a train, or the like.

The gas turbine includes a compressor, a combustor, and a turbine. The compressor draws and compresses outside air and transmits the compressed air to the combustor. The combustor mixes fuel with the compressed air supplied from the compressor, and combusts the mixture of the fuel and the compressed air to generate high-pressure and a high-temperature combustion gas. The combustion gas generated by the combustion is discharged to the turbine. As the combustion gas generates a rotational force by passing through a turbine vane and a turbine blade, and accordingly, a rotor of the turbine is rotated.

A ring segment is installed in the turbine to prevent a leakage of high-temperature and high-pressure combustion gas which rotates the rotor and consequently enhances the efficiency of the gas turbine. The ring segment is installed within a turbine casing which accommodates the turbine blade and is positioned to surround an outer circumference of the turbine blade. At this time, one surface of the ring segment facing an inner space of the turbine casing is exposed to the high-temperature and high-pressure combustion gas to generate high thermal load, and the ring segment may be damaged by the thermal load. The ring segment includes a plurality of cooling passages to prevent damage due to the thermal load, and research and development of a cooling structure which improves cooling efficiency to prevent damage due to thermal load is conducted continuously.

SUMMARY

Aspects of one or more exemplary embodiments provide a ring segment, a turbine, and a gas turbine having improved cooling performance.

Additional aspects will be set forth in part in the description which follows and, in part, will become apparent from the description, or may be learned by practice of the exemplary embodiments.

According to an aspect of an exemplary embodiment, there is provided a ring segment including: a shielding wall mounted to a turbine casing which accommodates a turbine blade and configured to face an inner circumferential surface of the turbine casing, a first hook part and a second hook part configured to protrude from the shielding wall toward the turbine casing to be coupled to the turbine casing, a main cavity formed between the first hook part and the second hook part, a plurality of first cooling passages configured to connect the main cavity and first side surfaces facing each other of the shielding wall, a plurality of second cooling passages configured to extend in a direction crossing the first cooling passage and connect the main cavity with second side surface facing each other of the shielding wall, and a chamber configured to be connected to the first cooling passages.

The first side surface may be formed to face a neighboring ring segment, and the second side surface may be formed to face a neighboring turbine vane.

The chamber may be formed inside the shielding wall.

The chamber may be formed to extend from the first hook part toward the second hook part.

The first cooling passage may be formed to extend in a circumferential direction of the turbine, and the second cooling passage may be formed to extend in a longitudinal direction of a central axis of the turbine.

The ring segment may further include a reinforcing projection configured to protrude from the shielding wall and extend from the first hook part toward the second hook part.

An inlet of the first cooling passage may be formed on an inner surface of the reinforcing projection, and an outlet of the first cooling passage may be formed on the first side surface.

The chamber may be formed to extend from an interior of the shielding wall to an interior of the reinforcing projection.

An upper surface of the chamber may be positioned higher than an upper surface of the shielding wall, and a lower surface of the chamber may be positioned lower than the upper surface of the shielding wall.

A plurality of partition walls, each of which has one end fixed to the chamber, may be formed inside the chamber, and the partition walls neighboring and facing each other may have fixed ends fixed to different inner surfaces from each other of the chamber.

The chamber may have a circular longitudinal cross-sectional surface, and the first cooling passage may be connected in an eccentric direction with respect to a center of the chamber to induce swirl inside the chamber.

A plurality of chambers which are spaced apart from each other in a height direction of the reinforcing projection and have a circular longitudinal cross-sectional surface may be formed to be connected in the first cooling passage, and the chambers may be communicated with each other by a connection passage extending in an eccentric direction with respect to a center of the chamber.

The chamber may include a plurality of porous plates which are spaced in a height direction of the chamber, the porous plate being formed to extend in a longitudinal direction of the chamber.

According to an aspect of another exemplary embodiment, there is provided a turbine including: a rotor disk configured to be rotatable, a plurality of turbine blades and turbine vanes which are installed on the rotor disk, a turbine casing which accommodates the turbine blades and the turbine vanes, and a plurality of ring segments which are mounted to the turbine casing and are positioned outside the turbine blade. The ring segment may include a shielding wall configured to face the inner circumferential surface of the turbine casing, and a first hook part and a second hook part configured to protrude from the shielding wall toward the turbine casing to be coupled to the turbine casing. The ring segment may include a plurality of first cooling passages extending in a circumferential direction of the turbine and a chamber configured to be connected to the first cooing passages and extend in a longitudinal direction of a central axis of the turbine.

The first cooling passage may connect a main cavity and a first side surface facing a neighboring ring segment, the main cavity being formed between the first hook part and the second hook part.

The turbine may further include a reinforcing projection configured to protrude from the shielding wall and extend from the first hook part toward the second hook part, and the chamber may be formed to extend from an interior of the shielding wall to an interior of the reinforcing projection.

The chamber may include a plurality of partition walls, each of which has one end fixed to the chamber, and the partition walls neighboring and facing each other may have fixed ends fixed to different inner surfaces from each other of the chamber.

The chamber may have a circular longitudinal cross-sectional surface, and the first cooling passage may be connected in an eccentric direction with respect to a center of the chamber to induce swirl inside the chamber.

The chamber may include a plurality of porous plates which are spaced in a height direction of the chamber, the porous plate being formed to extend in a longitudinal direction of the chamber.

According an aspect of another exemplary embodiment, there is provided a gas turbine including: a compressor configured to compress air drawn thereinto from an outside, a combustor configured to mix fuel with air compressed by the compressor and combust a mixture of the fuel and the compressed air, and a turbine comprising a plurality of turbine blades configured to be rotated by combustion gas discharged from the combustor. The turbine may include a rotor disk configured to be rotatable, a plurality of turbine blades and turbine vanes which are installed on the rotor disk, a turbine casing which accommodates the turbine blades and the turbine vanes, and a plurality of ring segments which are mounted to the turbine casing and are positioned outside the turbine blade. The ring segment may include a shielding wall configured to face an inner circumferential surface of the turbine casing, and a first hook part and a second hook part configured to protrude from the shielding wall toward the turbine casing to be coupled to the turbine casing, and the ring segment may include a plurality of first cooling passages extending in a circumferential direction of the turbine and a chamber configured to be connected to the first cooing passages and extend in a longitudinal direction of a central axis of the turbine.

According to the ring segment and the turbine according to an aspect of the exemplary embodiments, the first cooling passage and the second cooling passage crossing the first cooling passage are formed, and the first cooling passage is connected by the chambers to increase a residence time of a refrigerant and expand a contact area of the refrigerant, thereby improving the cooling efficiency.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
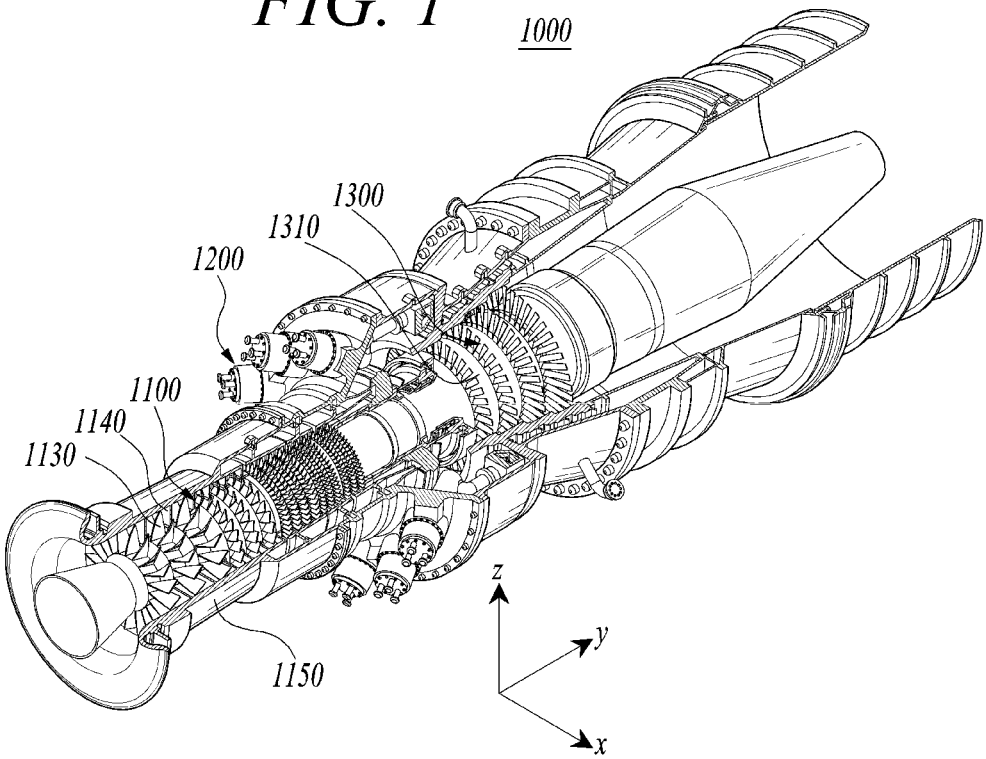
FIG. 1 is a diagram illustrating an internal structure of a gas turbine according to an exemplary embodiment.

Various changes and various embodiments will be described in detail with reference to the drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the sprit and technical scope disclosed herein.

The terminology used herein is for the purpose of describing specific embodiments only, and is not intended to limit the scope of the disclosure. The singular expressions "a", "an", and "the" may include the plural expressions as well, unless the context clearly indicates otherwise. In the disclosure, the terms such as "comprise", "include", "have/has" should be construed as designating that there are such features, integers, steps, operations, components, parts, and/or combinations thereof, not to exclude the presence or possibility of adding one or more other features, integers, steps, operations, components, parts and/or combinations thereof.

Further, terms such as "first," "second," and so on may be used to describe a variety of elements, but the elements should not be limited by these terms. The terms are used simply to distinguish one element from other elements. The use of such ordinal numbers should not be construed as limiting the meaning of the term. For example, the components associated with such an ordinal number should not be limited in the order of use, placement order, or the like. If necessary, each ordinal number may be used interchangeably.

Hereinafter, exemplary embodiments will be described in detail with reference to the accompanying drawings. Reference now should be made to the drawings, in which the same reference numerals are used throughout the different drawings to designate the same or similar components. Details of well-known configurations and functions may be omitted to avoid unnecessarily obscuring the gist of the present disclosure. For the same reason, some components in the accompanying drawings are exaggerated, omitted, or schematically illustrated.

Figure 2:
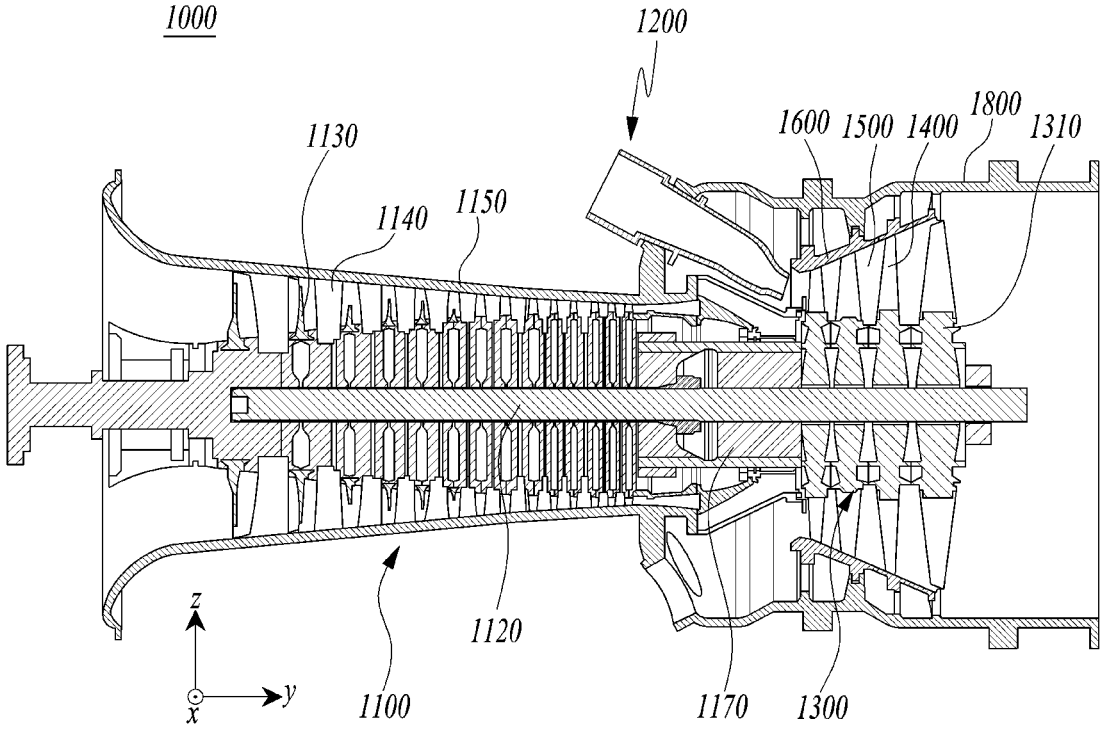
FIG. 2 is a longitudinal cross-sectional diagram illustrating a part of the gas turbine of FIG. 1.

FIG. 1 is a diagram illustrating an internal structure of a gas turbine according to an exemplary embodiment, and FIG. 2 is a longitudinal cross-sectional diagram illustrating a part of the gas turbine of FIG. 1.

For example, a thermodynamic cycle of a gas turbine 1000 according to the exemplary embodiment may ideally comply with a Brayton cycle. The Brighton cycle may be composed of four processes which include an isentropic compression (i.e., adiabatic compression), a constant-pressure rapid heating, an isentropic expansion (i.e., adiabatic expansion), and a constant-pressure heat dissipation. In other words, the gas turbine may draw the atmospheric air, compress the air to high pressure, combust fuel in a constant-pressure environment to emit thermal energy, expand the high-temperature combustion gas to convert the thermal energy of the combustion gas into kinetic energy and discharge exhaust gas containing residual energy to the atmosphere. That is, the Brayton cycle may be performed in four processes including compression, heating, expansion, and heat dissipation.

Referring to FIGS. 1 and 2, the gas turbine 1000 embodying the Brayton cycle may include a compressor 1100, a combustor 1200, and a turbine 1300.

The compressor 1100 of the gas turbine 1000 may draw air from the outside and compress the air. The compressor 1100 may supply the compressed air compressed by a compressor blade 1130 to the combustor 1200, and also supply the compressed air for cooling to a high-temperature region needed to be cooled in the gas turbine 1000. Here, because the drawn air is subjected to an adiabatic compression process in the compressor 1100, the pressure and temperature of the air passing through the compressor 1100 are increased.

The compressor 1100 is designed in the form of a centrifugal compressor or an axial compressor. The centrifugal compressor is used in a small gas turbine, whereas a multi-stage axial compressor 1100 is used in a large gas turbine such as the gas turbine 1000 illustrated in FIG. 1 to compress a large amount of air. In the multi-stage axial compressor 1100, a compressor blade 1130 moves the compressed air to a compressor vane 1140 disposed at a following stage while compressing the introduced air by rotating along with rotation of a center tie rod 1120 and a rotor disk. The air is compressed gradually to a high pressure while passing through the compressor blade 1130 formed in a multi-stage structure.

The compressor vane 1140 is mounted inside a housing 1150 in such a way that a plurality of compressor vanes 1140 form each stage. The compressor vane 1140 guides the compressed air moved from the compressor blade 1130 disposed at a preceding stage toward the compressor blade 1130 disposed at the following stage. In an exemplary embodiment, at least some of the plurality of compressor vanes 1140 may be mounted to be rotatable within a predetermined range for adjusting the amount of introduced air.

The compressor 1100 may be driven by using some of the power output from the turbine 1300. To this end, a rotary shaft of the compressor 1100 and a rotary shaft of the turbine 1300 may be directly connected by a torque tube 1170. In the case of the large gas turbine 1000, almost half of the output produced by the turbine 1300 may be consumed to drive the compressor 1100.

The combustor 1200 may produce high-energy combustion gas by mixing and combusting, at constant pressure, the compressed air supplied from the compressor 1100 with the fuel. The combustor 1200 produces high-temperature and high-pressure combustion gas having high energy by mixing and combusting the introduced compressed air with the fuel, and increases the temperature of the combustion gas to a heat-resistant limit temperature at which the combustor and the turbine may withstand through the constant pressure combustion process.

A plurality of combustors constituting the combustor 1200 may be arranged within the housing in a form of a cell. Each of the combustors includes a burner which includes a fuel injection nozzle, a combustor liner which forms a combustion chamber, and a transition piece which becomes a connection part between the combustor and the turbine.

The high-temperature and high-pressure combustion gas from the combustor 1200 is supplied to the turbine 1300. The supplied high-temperature and high-pressure combustion gas expands and applies impingement or reaction force to a turbine blade 1400 of the turbine 1300 to generate rotation torque. A portion of the rotation torque is delivered to the compressor 1100 through the torque tube 1170, and remaining portion which is the excessive torque is used to drive a generator or the like.

The turbine 1300 includes a rotor disk 1310, a turbine casing 1800, a plurality of turbine blades 1400 which are radially arranged on the rotor disk 1310, a plurality of turbine vanes 1500, and a plurality of ring segments 1600 surrounding the turbine blades 1400.

The rotor disk 1310 has a substantially disk shape, and a plurality of grooves are formed in an outer circumferential portion thereof. The groove is formed to have a curved surface, and the turbine blade 1400 and the vane 1500 are inserted into the groove. The turbine casing 1800 is formed of a tube having a conical shape, and the turbine blade 1400, the turbine vane 1500, and the ring segment 1600 are accommodated within the turbine casing 1800.

The turbine blade 1400 may be coupled to the rotor disk 1310 in a dovetail manner or the like. The turbine vane 1500 is fixed not to rotate and guides a flow direction of the combustion gas passing through the turbine blade 1400.

Figure 3:
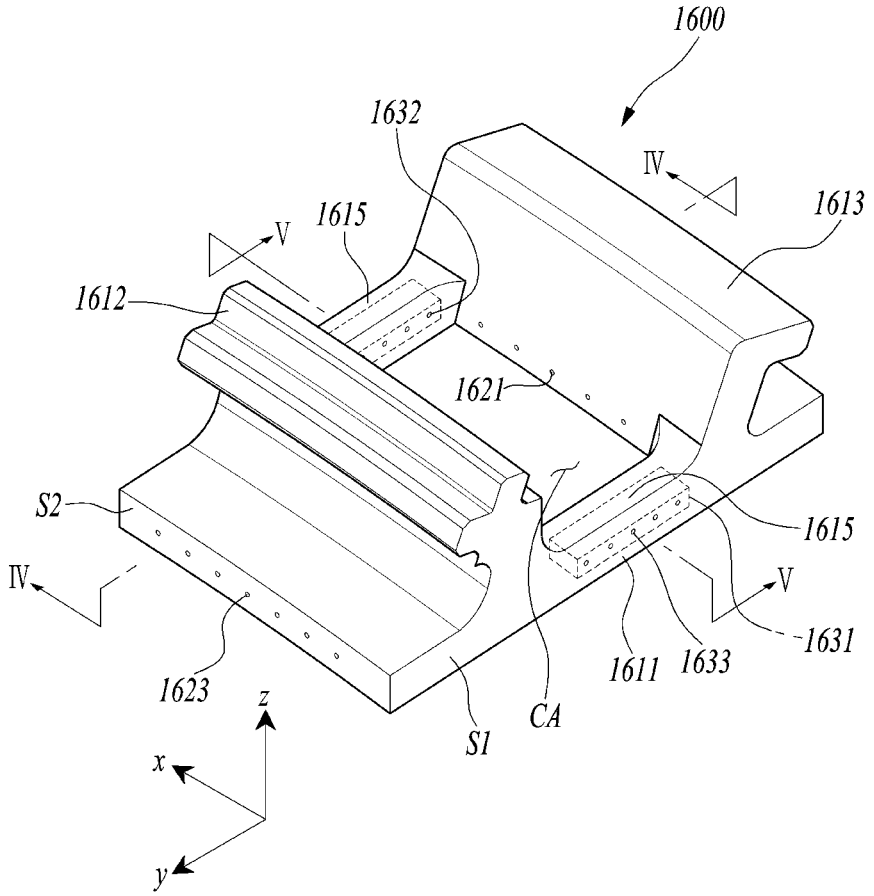
FIG. 3 is a perspective diagram illustrating a ring segment according to an exemplary embodiment.
Figure 4:
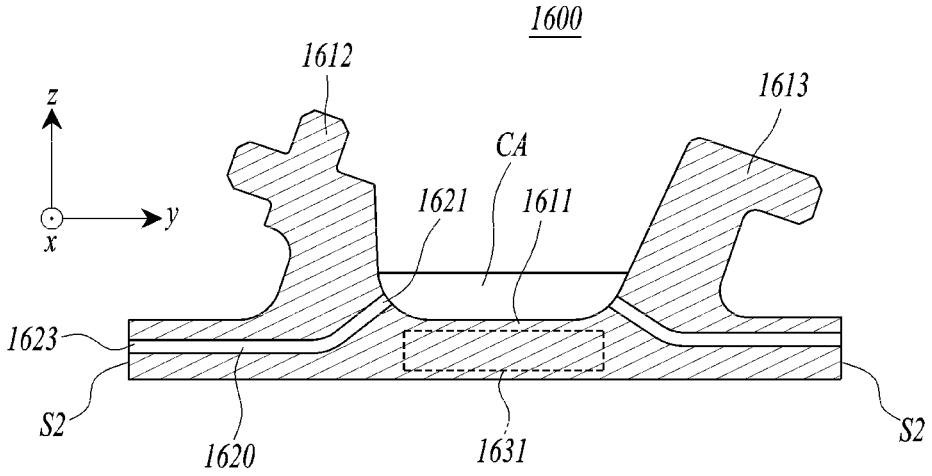
FIG. 4 is a longitudinal cross-sectional diagram taken along line IV-IV in FIG. 3.
Figure 5:
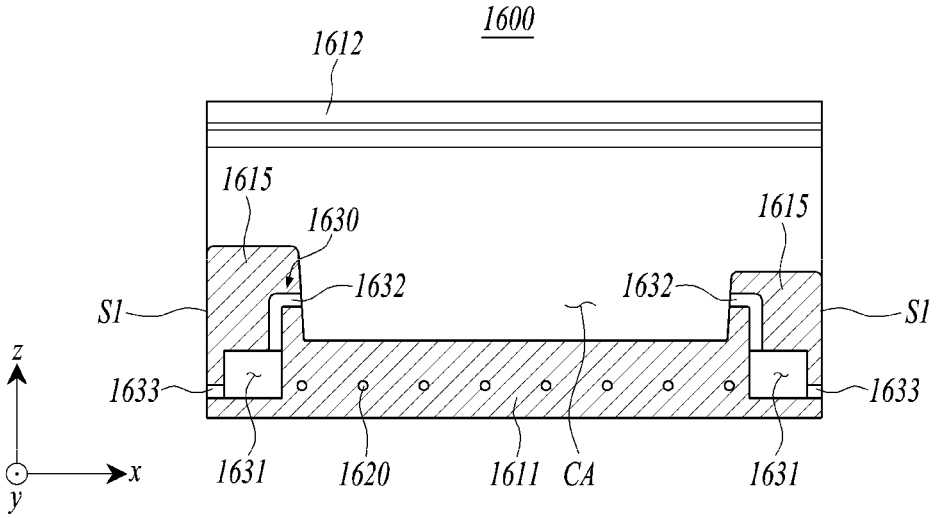
FIG. 5 is a longitudinal cross-sectional diagram taken along line V-V in FIG. 3.

FIG. 3 is a perspective diagram illustrating a ring segment according to the exemplary embodiment, FIG. 4 is a longitudinal cross-sectional diagram taken along line IV-IV in FIG. 3, and FIG. 5 is a longitudinal cross-sectional diagram taken along line V-V in FIG. 3.

The ring segment 1600 is mounted to an inner wall of the turbine casing 1800, and the plurality of ring segments 1600 are consecutively arranged along a circumferential direction (i.e., x-axis direction) of the turbine casing 1800 to form a ring shape. The ring segments 1600 forming a ring shape surround the turbine blades 1400 outside the turbine blades 1400, and prevent a leakage of the combustion gas. In addition, in a longitudinal direction (i.e., y-axis direction) of a central axis of the turbine 1300, the ring segments 1600 are alternately arranged with the turbine vanes 1500, and the ring segments 1600 are inserted between outer shrouds of the turbine vanes 1500 to face the turbine vanes 1500.

Referring to FIGS. 3 to 5, the ring segment 1600 includes a shielding wall 1611, a first hook part 1612, a second hook part 1613, a main cavity (CA), a first cooling passage 1630, a second cooling passage 1620, a reinforcing projection 1615, and a chamber 1631. The shielding wall 1611 may be a square plate and the first hook part 1612 and the second hook part 1613 protrudes in a radial direction (i.e., z-axis direction) of the turbine 1300 from an outer surface of the shielding wall 1611 toward the turbine casing 1800 to be inserted into the groove formed in the turbine casing 1800. The main cavity (CA) is formed between the first hook part 1612 and the second hook part 1613 and air for cooling is supplied to the main cavity (CA).

The reinforcing projection 1615 protrudes from the shielding wall 1611 and is formed by extending from the first hook part 1612 toward the second hook part 1613. Two reinforcing projections 1615 are formed on the shielding wall 1611 and protrude from both sides of the shielding wall 1611. The reinforcing projection 1615 may extend from the first hook part 1612 to the second hook part 1613 to connect the first hook part 1612 and the second hook part 1613. The main cavity (CA) is formed by being surrounded by the first hook part 1612, the second hook part 1613, and the reinforcing projections 1615.

The first cooling passage 1630 connects the main cavity (CA) and first side surfaces (S1) facing each other of the shielding wall 1611. The first cooling passage 1630 is formed to extend in a circumferential direction (i.e., x-axis direction) of the turbine 1300, and a plurality of first cooling passages 1630 are arranged to be spaced apart from each other in the longitudinal direction (i.e., y-axis direction) of the central axis of the turbine 1300.

An inlet 1632 of the first cooling passage 1630 is formed on an inner surface of the reinforcing projection 1615, and an outlet 1633 of the first cooling passage 1630 is formed on the first side surface (S1). As described above, because the plurality of ring segments 1600 are consecutively arranged in the circumferential direction (i.e., x-axis direction) of the turbine 1300, the first side surface (S1) faces and contacts neighboring ring segments 1600.

The second cooling passage 1620 is formed to extend in a direction crossing the first cooling passage 1630, and may be formed to extend in a direction perpendicular to the first cooling passage 1630. The second cooling passage 1620 connects the main cavity (CA) and second side surfaces (S2) facing each other of the shielding wall 1611.

The second cooling passage 1620 is formed to extend in a longitudinal direction (i.e., y-axis direction) of the central axis of the turbine 1300. An inlet 1621 of the second cooling passage 1620 is formed on a lower portion inside the first hook part 1612 and the second hook part 1613, and an outlet 1623 of the second cooling passage 1620 is formed on the second side surface (S2). Accordingly, the second cooling passage 1620 is positioned between the chambers 1631 and does not communicate with the chambers 1631.

The chamber 1631 is formed to be connected to the first cooling passages 1630, and is formed inside the shielding wall 1611. The chamber 1631 is formed to extend from the first hook part 1612 toward the second hook part 1613, that is, in a longitudinal direction (i.e., y-axis direction) of the central axis of the turbine 1300. The ring segment 1600 including the first cooling passage 1630, the second cooling passage 1620, and the chamber 1631 may be manufactured by additive manufacturing.

The air introduced into the main cavity (CA) is introduced into the first cooling passage 1630. The air introduced into the first cooling passages 1630 is joined in the chamber 1631 and is distributed to the respective first cooling passages 1630 to be discharged to the first side surface (S1). If the chamber 1631 connecting the first cooling passages 1630 is formed inside the ring segment 1600, the residence time of air may increase, thereby improving the cooling efficiency. In addition, if air is introduced from the first cooling passage 1630 to the chamber 1631, the air may hit an inner wall of the chamber 1631, thereby further improving the cooling efficiency. The air discharged from the first cooling passage 1630 is cooled while hitting a side surface of a neighboring ring segment 1600 and discharged inward. Accordingly, the air discharged from the first cooling passage 1630 may also form an air curtain, thereby preventing hot air from being introduced between the ring segments 1600.

Figure 6:
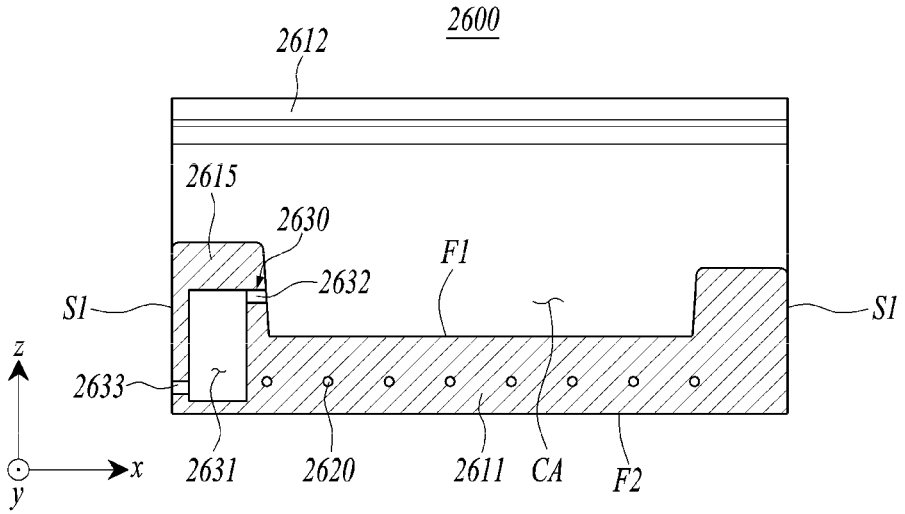
FIG. 6 is a longitudinal cross-sectional diagram illustrating a ring segment according to another exemplary embodiment.

FIG. 6 is a longitudinal cross-sectional diagram illustrating a ring segment 2600 according to another exemplary embodiment.

Because a ring segment 2600 is same as the ring segment 1600 of FIGS. 3 to 5 except for a structure of a first cooling passage 2630 and a chamber 2631, redundant description will be omitted.

Referring to FIG. 6, a shielding wall 2611 may be a square plate and a first hook part 2612 and a second hook part (not illustrated) may be formed on an outer surface of the shielding wall 2611. If a surface facing the turbine casing on the shielding wall 2611 is referred to as a target surface (F1) on which cooling air hits and a surface facing the turbine blade is referred to as a hot side surface (F2), the main cavity (CA) is formed on the target surface (F1) side. The main cavity (CA) is formed between the first hook part 2612 and the second hook part, and air for cooling is supplied to the main cavity (CA).

A reinforcing projection 2615 may extend from the first hook part 2612 to the second hook part to connect the first hook part 2612 and the second hook part. The first cooling passage 2630 connects the main cavity (CA) and one first side surface (S1) of the shielding wall 2611. The first cooling passage 2630 is formed to extend in a circumferential direction (i.e., x-axis direction) of the turbine, and a plurality of first cooling passages 2630 are arranged to be spaced apart from each other in a longitudinal direction (i.e., y-axis direction) of the central axis of the turbine. Here, the first cooling passage 2630 is formed only inside the side surface of the ring segment 2600 positioned in a direction (i.e., x-axis direction) in which the turbine blade rotates. That is, the first cooling passage 2630 discharges air only in a rotational direction of the turbine blade from the side surface of the ring segment 2600 facing in the same direction as a tip of the turbine blade.

If the first cooling passage 2630 is formed at both sides of the ring segment 2600, the cooling efficiency may be improved but because air is discharged in a direction opposite to the direction in which the turbine blade rotates, a flow having rotational momentum from the turbine blade may be introduced into a gap between the respective ring segments 2600, thereby obstructing an outlet flow of the cooling air. However, as in the exemplary embodiment, if the first cooling passage 2630 discharges air only in a direction in which the turbine blade rotates, stable cooling may be performed without being obstructed by the flow introduced from the turbine blade. An inlet 2632 of the first cooling passage 2630 is formed on an inner surface of the reinforcing projection 2615, and an outlet 2633 of the first cooling passage 2630 is formed on the first side surface (S1). As described above, because a plurality of ring segments 2600 are arranged consecutively in a circumferential direction of the turbine, the first side surface (S1) faces a neighboring ring segment 2600. The outlet 2633 of the first cooling passage 2630 has a structure in which an inner diameter gradually decreases from the interior to the exterior. Accordingly, by increasing a velocity of the air injected from the outlet 2633 of the first cooling passage 2630, it is possible to block hot gas from being introduced between the ring segments 2600.

The second cooling passage 2620 connects the main cavity (CA) and the second side surfaces facing each other of the shielding wall 2611. The second cooling passage 2620 is formed to extend in a longitudinal direction (i.e., y-axis direction) of the central axis of the turbine.

The chamber 2631 is formed to be connected to the first cooling passages 2630, and is formed to extend from an interior of the shielding wall 2611 to an interior of the reinforcing projection 2615. Accordingly, an upper surface of the chamber 2631 is positioned higher than an upper surface of the shielding wall 2611, and a lower surface of the chamber 2631 is positioned lower than the upper surface of the shielding wall 2611.

The chamber 2631 is formed to extend in a longitudinal direction (i.e., y-axis direction) of the central axis of the turbine. However, the chamber 2631 is formed only in a portion adjacent to the side surface of the ring segment facing the direction in which the turbine blade rotates (i.e., x-axis direction). Here, the direction in which the turbine blade rotates means a direction in which the tip of the turbine blade faces.

The air introduced into the main cavity (CA) is introduced into the first cooling passage 2630. The air introduced into the first cooling passages 2630 is joined in the chamber 2631 and is distributed to the respective first cooling passages 2630 to be discharged to the first side surface (S1). As described above, if the chamber 2631 connecting the first cooling passages 2630 is formed inside the ring segment 2600, the residence time of the air may increase, thereby improving the cooling efficiency. In addition, if the air is introduced into the chamber 2631 from the first cooling passage 2630, the air may hit the inner wall of the chamber 2631, thereby further improving the cooling efficiency. The air discharged from the first cooling passage 2630 is cooled while hitting the side surface of the neighboring ring segment 2600 and discharged inward. Because the ring segment 2600 includes the first cooling passage 2630 and the chamber 2631 formed at only one side end thereof, the side surface in which the first cooling passage is not formed may be cooled by the air discharged from the neighboring ring segment 2600.

In addition, the chamber 2631 is formed to extend from the interior of the shielding wall 2611 to the interior of the reinforcing projection 2615, thereby expanding the heat transfer area, and the air may be cooled by absorbing the heat from the reinforcing projection 2615, thereby further improving the cooling efficiency.

Figure 7:
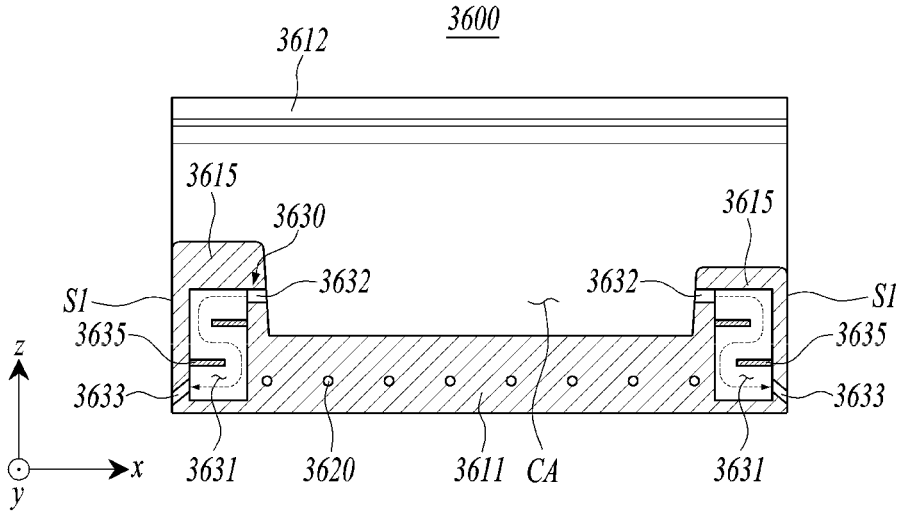
FIG. 7 is a longitudinal cross-sectional diagram illustrating a ring segment according to another exemplary embodiment.

FIG. 7 is a longitudinal cross-sectional diagram illustrating a ring segment 3600 according to another exemplary embodiment.

Because a ring segment 3600 is same as the ring segment 1600 of FIGS. 3 to 5 except for a structure of a first cooling passage 3630 and a chamber 3631, redundant description will be omitted.

Referring to FIG. 7, a shielding wall 3611 may be a square plate and a first hook part 3612 and a second hook part (not illustrated) may be formed on an outer surface of the shielding wall 3611. The main cavity (CA) is formed between the first hook part 3612 and the second hook part and air for cooling is supplied to the main cavity (CA).

A reinforcing projection 3615 protrudes outward from the shielding wall 3611 toward the turbine casing, and may connect the first hook part 3612 and the second hook part. The first cooling passage 3630 connects the main cavity (CA) and first side surfaces (S1) facing each other of the shielding wall 3611. The first cooling passage 3630 is formed consecutively in a circumferential direction (i.e., x-axis direction) of the turbine, and a plurality of first cooling passages 3630 are arranged to be spaced apart from each other in a longitudinal direction (i.e., y-axis direction) of the central axis of the turbine.

An inlet 3632 of the first cooling passage 3630 is formed on an inner surface of the reinforcing projection 3615, and an outlet 3633 of the first cooling passage 3630 is formed on the first side surface (S1). The outlet 3633 of the first cooling passage 3630 is formed to be inclined in a direction toward the turbine blade with respect to the first side surface (S1). If the outlet 3633 of the first cooling passage 3630 is formed to be inclined, it is possible to block hot gas from being introduced between the ring segments by the air discharged from the first cooling passage 3630. As described above, because the plurality of ring segments 3600 are arranged consecutively in a circumferential direction of the turbine, the first side surface (S1) faces the neighboring ring segment 3600.

The second cooling passage 3620 connects the main cavity (CA) and second side surfaces facing each other of the shielding wall 3611. The second cooling passage 3620 is formed to extend in a longitudinal direction (i.e., y-axis direction) of the central axis of the turbine.

The chamber 3631 is formed to be connected to the first cooling passages 3630, and is formed to extend from the interior of the shielding wall 3611 to the interior of the reinforcing projection 3615. The chamber 3631 is formed to extend in a longitudinal direction (i.e., y-axis direction) of the central axis of the turbine. Two chambers 3631 are disposed to be spaced apart from each other in a circumferential direction (i.e., x-axis direction) of the turbine inside the ring segment.

A plurality of partition walls 3635, each of which has only one end fixed to the inner surface of the chamber 3631, may be formed inside the chamber 3631. The partition walls 3635 are disposed to be spaced apart from each other in a height direction of the chamber 3631. The partition walls 3635 neighboring and facing each other have fixed ends fixed to different inner surfaces of the chamber 3631, and have free ends positioned above and below the portion in which the neighboring partition walls 3635 are fixed. That is, if the partition wall 3635 formed on an upper portion thereof is fixed to the first surface of the chamber 3631 and is spaced apart from the second surface facing the first surface, the partition wall 3635 formed on a lower portion thereof is spaced apart from the first surface to be fixed to the second surface.

Accordingly, the air within the chamber 3631 forms a serpentine flow in a serpentine shape. If the partition wall 3635 is formed inside the chamber 3631, the air may hit the partition wall 3635, thereby improving the cooling efficiency and in addition, the residence time of the air may increase, thereby improving the cooling efficiency.

Figure 8:
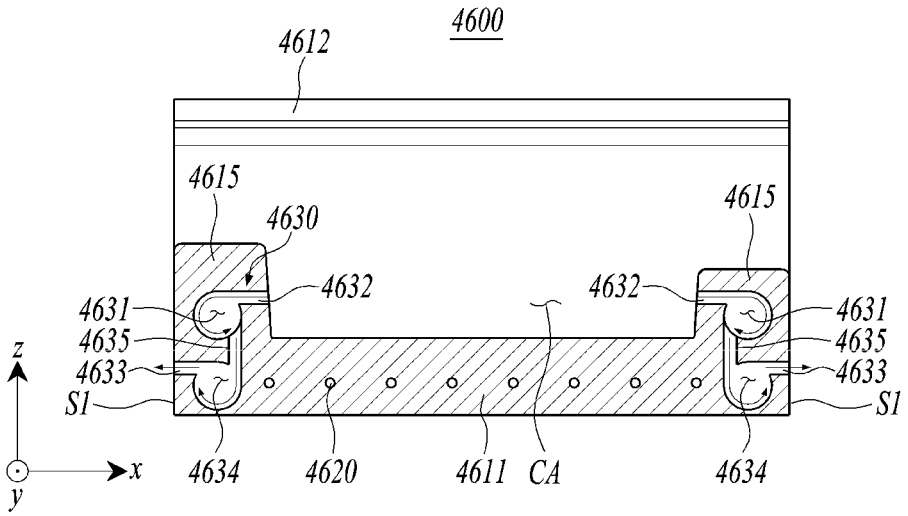
FIG. 8 is a longitudinal cross-sectional diagram illustrating a ring segment according to another exemplary embodiment.

FIG. 8 is a longitudinal cross-sectional diagram illustrating a ring segment 4600 according to another exemplary embodiment.

Because a ring segment 4600 is same as the ring segment 1600 of FIGS. 3 to 5 except for a structure of a first cooling passage 4630 and a chamber 4631, redundant description will be omitted.

Referring to FIG. 8, a shielding wall 4611 may be a square plate and a first hook part 4612 and a second hook part (not illustrated) may be formed on an outer surface of the shielding wall 4611. The main cavity (CA) is formed between the first hook part 4612 and the second hook part and air for cooling is supplied to the main cavity (CA).

A reinforcing projection 4615 may protrude outward from the shielding wall 4611 toward the turbine casing, and extend in a longitudinal direction (i.e., y-axis direction) of the central axis of the turbine to connect the first hook part 4612 and the second hook part. The first cooling passage 4630 connects the main cavity (CA) and first side surfaces (S1) facing each other of the shielding wall 4611. The first cooling passages 4630 may be formed at both sides of the shielding wall 4611, respectively, with the main cavity (CA) interposed therebetween.

The first cooling passage 4630 is formed to extend in a circumferential direction (i.e., x-axis direction) of the turbine, and a plurality of first cooling passages 4630 are arranged to be spaced apart from each other in a longitudinal direction (i.e., y-axis direction) of the central axis of the turbine.

An inlet 4632 of the first cooling passage 4630 is formed on an inner surface of the reinforcing projection 4615, and an outlet 4633 of the first cooling passage 4630 is formed on the first side surface (S1). As described above, because a plurality of ring segments 4600 are arranged consecutively in a circumferential direction of the turbine, the first side surface (S1) faces the neighboring ring segment 4600.

The second cooling passage 4620 connects the main cavity (CA) and the second side surfaces facing each other of the shielding wall 4611. The second cooling passage 4620 is formed in a direction crossing the first cooling passage 4630 and is formed to extend in a longitudinal direction (i.e., y-axis direction) of the central axis of the turbine.

A plurality of chambers are formed within the shielding wall 4611, and are formed to be connected to the first cooling passages 4630. A first chamber 4631 and a second chamber 4634 are disposed to be spaced apart from each other in a height direction of the reinforcing projection 4615. The first chamber 4631 and the second chamber 4634 have a circular longitudinal cross-section surface. The first cooling passage 4630 is connected in an eccentric direction with respect to the centers of the first chamber 4631 and the second chamber 4634 to induce swirl inside the first chamber 4631. The first cooling passage 4630 may be in a tangential direction therebetween connected to the first chamber 4631 and the second chamber 4634 to be able to induce the swirl.

In addition, the first cooling passage 4630 may further include a connection passage 4635 which connects the first chamber 4631 and the second chamber 4634. The connection passage 4635 is connected to the first chamber 4631 and the second chamber 4634 in an eccentric direction with respect to the centers of the first chamber 4631 and the second chamber 4634. Alternatively, the connection passage 4635 may be connected to the first chamber 4631 and the second chamber 4634 in a tangential direction between the first chamber 4631 and the second chamber 4634.

If a plurality of chambers are formed inside the ring segment 4600 and the first cooling passage 4630 is connected in an eccentric direction with respect to the centers of the first chamber 4631 and the second chamber 4634, the swirl may be formed inside the first chamber 4631 and the second chamber 4634, thereby further improving the cooling efficiency.

Figure 9:
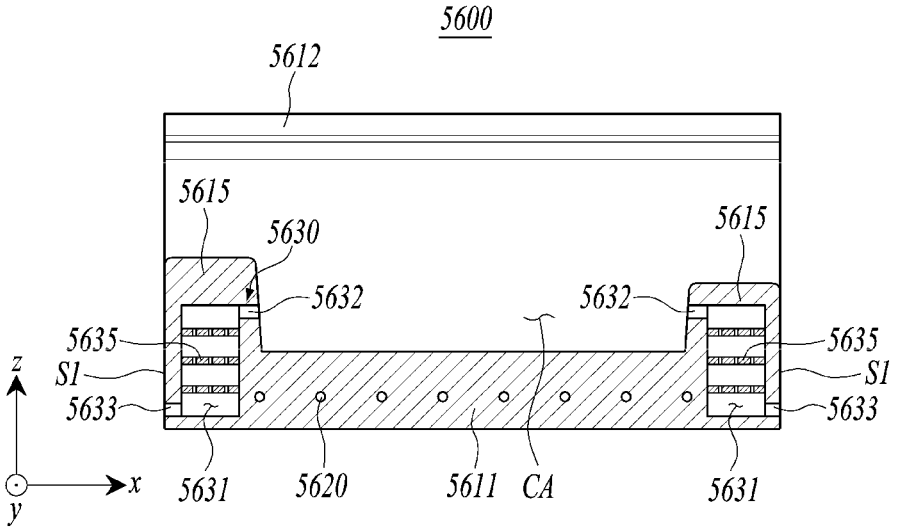
FIG. 9 is a longitudinal cross-sectional diagram illustrating a ring segment according to another exemplary embodiment.

FIG. 9 is a longitudinal cross-sectional diagram illustrating a ring segment 5600 according to another exemplary embodiment.

Because a ring segment 5600 is same as the ring segment 1600 of FIGS. 3 to 5 except for a structure of a first cooling passage 5630 and a chamber 5631, redundant description will be omitted.

Referring to FIG. 9, a shielding wall 5611 may be a square plate and a first hook part 5612 and a second hook part (not illustrated) may be formed on an outer surface of the shielding wall 5611. The main cavity (CA) is formed between the first hook part 5612 and the second hook part, and air for cooling is supplied to the main cavity (CA).

A reinforcing projection 5615 may protrude outward from the shielding wall 5611 toward the turbine casing, and extend in a longitudinal direction (i.e., y-axis direction) of the central axis of the turbine to connect the first hook part 5612 and the second hook part. The first cooling passage 5630 connects the main cavity (CA) and first side surfaces (S1) facing each other of the shielding wall 5611. The first cooling passages 5630 may be formed at both sides of the shielding wall 5611, respectively, with the main cavity (CA) interposed therebetween.

The first cooling passage 5630 is formed to extend in a circumferential direction (i.e., x-axis direction) of the turbine, and a plurality of first cooling passages 5630 are arranged to be spaced apart from each other in a longitudinal direction (i.e., y-axis direction) of the central axis of the turbine.

An inlet 5632 of the first cooling passage 5630 is formed on an inner surface of the reinforcing projection 5615, and an outlet 5633 of the first cooling passage 5630 is formed on the first side surface (S1). As described above, because the plurality of ring segments 5600 are arranged consecutively in a circumferential direction of the turbine, the first side surface (S1) faces the neighboring ring segment 5600.

A second cooling passage 5620 connects the main cavity (CA) and second side surfaces facing each other of the shielding wall 5611. The second cooling passage 5620 is formed to extend in a longitudinal direction (i.e., y-axis direction) of the central axis of the turbine.

The chamber 5631 is formed to be connected to the first cooling passages 5630, and is formed to extend from the interior of the shielding wall 5611 to the interior of the reinforcing projection 5615. The chamber 5631 is formed to extend in a longitudinal direction (i.e., y-axis direction) of the central axis of the turbine. Two chambers 5631 are disposed to be spaced apart from each other in a circumferential direction (i.e., x-axis direction) of the turbine inside the ring segment 5600.

A plurality of porous plates 5635 are disposed to be spaced apart from each other in a height direction of the chamber 5631 inside the chamber 5631. The porous plate 5635 may be a substantially rectangular plate, and may be formed to extend in a longitudinal direction (i.e., y-axis direction) of the chamber 5631. A plurality of holes may be formed in the porous plate 5635, and the air may be discharged from the chamber 5631 by passing through the porous plate 5635. Accordingly, the air may receive heat through the porous plate 5635 within the chamber 5631, thereby improving the cooling efficiency of the ring segment 5600.

While exemplary embodiments have been described with reference to the accompanying drawings, it will be apparent to those skilled in the art that various modifications in form and details may be made therein without departing from the spirit and scope as defined in the appended claims. Therefore, the description of the exemplary embodiments should be construed in a descriptive sense and not to limit the scope of the claims, and many alternatives, modifications, and variations will be apparent to those skilled in the art.

What is claimed is:

1. A ring segment comprising:

a shielding wall mounted to a turbine casing which accommodates a turbine blade and configured to face an inner circumferential surface of the turbine casing;

a first hook part and a second hook part configured to protrude from the shielding wall toward the turbine casing to be coupled to the turbine casing;

a main cavity formed between the first hook part and the second hook part;

a plurality of first cooling passages configured to connect the main cavity and first side surfaces facing each other of the shielding wall;

a plurality of second cooling passages configured to extend in a direction crossing the first cooling passages and connect the main cavity and second side surfaces facing each other of the shielding wall; and a plurality of chambers configured to be connected to the first cooling passages, wherein the first cooling passages are connected in an eccentric direction with respect to centers of the plurality of chambers to induce swirl inside the plurality of chambers, wherein each of the plurality of first cooling passages includes a connection passage which connects a first chamber and a second chamber of the plurality of chambers, the connection passage being connected in it eccentric direction with respect to centers of the first and second chambers.

2. The ring segment of claim 1, wherein the first side surface faces a neighboring ring segment, and the second side surface faces a neighboring turbine vane.

3. The ring segment of claim 1, wherein the plurality of chambers are formed inside the shielding wall.

4. The ring segment of claim 1, wherein the plurality of chambers are formed to extend from the first hook part toward the second hook part.

5. The ring segment of claim 1, wherein the first cooling passages are formed to extend in a circumferential direction of the turbine, and wherein the second cooling passages are formed to extend in a longitudinal direction of a central axis of the turbine.

6. The ring segment of claim 1, further comprising a reinforcing projection configured to protrude from the shielding wall and extend from the first hook part toward the second hook part.

7. The ring segment of claim 6, wherein an inlet of the first cooling passages is formed on an inner surface of the reinforcing projection, and an outlet of the first cooling passages is formed on the first side surface.

8. The ring segment of claim 6, wherein the first chamber is formed to extend from an interior of the shielding wall to an interior of the reinforcing projection.

9. The ring segment of claim 8, wherein an upper surface of the first chamber is positioned higher than an upper surface of the shielding wall, and a lower surface of the first chamber is positioned lower than the upper surface of the shielding wall.

10. The ring segment of claim 1, wherein each of the plurality of chambers has a circular longitudinal cross-sectional surface.

11. A ring segment comprising:

a shielding wall mounted to a turbine casing which accommodates a turbine blade and configured to face an inner circumferential surface of the turbine casing;

a first hook part and a second hook part configured to protrude from the shielding wall toward the turbine casing to be coupled to the turbine casing;

a main cavity formed between the first hook part and the second hook part;

a plurality of first cooling passages configured to connect the main cavity and first side surfaces facing each other of the shielding wall;

a plurality of second cooling passages configured to extend in a direction crossing the first cooling passages and connect the main cavity and second side surfaces facing each other of the shielding wall;

a plurality of chambers configured to be connected to the first cooling passages; and a reinforcing projection configured to protrude from the shielding wall and extend from the first hook part toward the second hook part, wherein the plurality of chambers which are spaced apart from each other in a height direction of the reinforcing projection are formed to be connected in the first cooling passages, and the chambers are communicated with each other by a connection passage extending in an eccentric direction with respect to a center of the chamber.

12. A turbine comprising:

a rotor disk configured to be rotatable;

a plurality of turbine blades and turbine vanes which are installed on the rotor disk; and a turbine casing which accommodates the turbine blades, the turbine vanes; and a plurality of ring segments which are mounted to the turbine casing and are positioned outside the turbine blade, wherein the ring segment comprises a shielding wall configured to face an inner circumferential surface of the turbine casing, and a first hook part and a second hook part configured to protrude from the shielding wall toward the turbine casing to be coupled to the turbine casing, and wherein the ring segment includes a plurality of first cooling passages extending in a circumferential direction of the turbine and a plurality of chambers configured to be connected to the first cooling passages and extend in a longitudinal direction of a central axis of the turbine, wherein the first cooling passages are connected in an eccentric direction with respect to centers of the plurality of chambers to induce swirl inside the plurality of chambers, wherein each of the plurality of first cooling passages includes a connection passage which connects a first chamber and a second chamber of the plurality of chambers, the connection passage being connected in an eccentric direction with respect to centers of the first and second chambers.

13. The turbine of claim 12, wherein the first cooling passages connect a main cavity and a first side surface facing a neighboring ring segment, the main cavity being formed between the first hook part and the second hook part.

14. The turbine of claim 12, further comprising a reinforcing projection configured to protrude from the shielding wall and extend from the first hook part toward the second hook part, wherein the first chamber is formed to extend from an interior of the shielding wall to an interior of the reinforcing projection.

15. A gas turbine comprising:

a compressor configured to compress air drawn thereinto from an outside;

a combustor configured to mix fuel with air compressed by the compressor and combust a mixture of the fuel and the compressed air; and a turbine comprising a plurality of turbine blades configured to be rotated by combustion gas discharged from the combustor, wherein the turbine comprises a rotor disk configured to be rotatable, a plurality of turbine blades and turbine vanes which are installed on the rotor disk, a turbine casing which accommodates the turbine blades and the turbine vanes, and a plurality of ring segments which are mounted to the turbine casing and are positioned outside the turbine blade, wherein the ring segment comprises a shielding wall configured to face an inner circumferential surface of the turbine casing, and a first hook part and a second hook part configured to protrude from the shielding wall toward the turbine casing to be coupled to the turbine casing, wherein the ring segment includes a plurality of first cooling passages extending in a circumferential direction of the turbine and a plurality of chambers configured to be connected to the first cooling passages and extend in a longitudinal direction of a central axis of the turbine, and wherein the first cooling passages are connected in an eccentric direction with respect to centers of the plurality of chambers to induce swirl inside the plurality of chambers, wherein each of the plurality of first cooling passages includes a connection passage which connects a first chamber and second chamber of the plurality of chambers, the connection passage being connected in an eccentric direction with respect to centers of the first and second chambers.

* * * * *